US009349507B2

(12) United States Patent
Vu et al.

(10) Patent No.: US 9,349,507 B2
(45) Date of Patent: May 24, 2016

(54) REDUCING SIGNAL LOSS IN CABLES

(71) Applicant: Apple Inc., Cupertino, CA (US)

(72) Inventors: My Vu, San Jose, CA (US); Nathan N. Ng, Fremont, CA (US); Min Chul Kim, Santa Clara, CA (US); Jason Squire, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 184 days.

(21) Appl. No.: 14/073,795

(22) Filed: Nov. 6, 2013

(65) Prior Publication Data

US 2014/0124236 A1 May 8, 2014

Related U.S. Application Data

(60) Provisional application No. 61/723,312, filed on Nov. 6, 2012.

(51) Int. Cl.
*H01B 7/00* (2006.01)
*H01B 11/10* (2006.01)

(52) U.S. Cl.
CPC ..... *H01B 11/1025* (2013.01); *H01B 11/1091* (2013.01)

(58) Field of Classification Search
USPC ..... 174/36, 110 R, 110 SP, 113 R, 113 AS, 174/113 C, 114 S, 115, 116
See application file for complete search history.

(56) References Cited

U.S. PATENT DOCUMENTS

| | | | | |
|---|---|---|---|---|
| 3,409,734 | A * | 11/1968 | De Vine et al. | 174/113 R |
| 5,142,100 | A * | 8/1992 | Vaupotic | 174/24 |
| 6,800,811 | B1 * | 10/2004 | Boucino | 174/113 C |
| 6,815,611 | B1 * | 11/2004 | Gareis | 174/36 |
| 7,531,749 | B2 * | 5/2009 | Archambeault et al. | 174/102 R |
| 7,649,142 | B2 * | 1/2010 | Archambeault et al. | 174/102 R |
| 2003/0111241 | A1 * | 6/2003 | Bahlmann et al. | 174/35 R |
| 2005/0029007 | A1 * | 2/2005 | Nordin et al. | 174/113 R |
| 2009/0223694 | A1 * | 9/2009 | Nordin et al. | 174/34 |
| 2009/0308633 | A1 * | 12/2009 | Dion et al. | 174/113 R |
| 2010/0282493 | A1 * | 11/2010 | Nordin et al. | 174/113 R |
| 2012/0000690 | A1 * | 1/2012 | Van Der Meer | 174/102 R |
| 2012/0227998 | A1 * | 9/2012 | Lindstrom et al. | 174/103 |

OTHER PUBLICATIONS

De Araujo, D.N. et al.; "Full-Wave, TwinAx, Differential Cable Modeling,"; *IEEE 2008 Electronic Components and Technology Conference*; 2008; pp. 1684-1689.

(Continued)

*Primary Examiner* — William Mayo, III
(74) *Attorney, Agent, or Firm* — Kilpatrick Townsend & Stockton LLP

(57) ABSTRACT

Cables capable of high-speed data transmission and having a low insertion loss. Examples may mitigate the effect of the suckout component of insertion loss by providing cables that eliminated, shift, or reduce the suckout. Examples may eliminate, or at least partially eliminate, the suckout component by providing a continuous return path. Others may shift the frequency of the suckout component to a high frequency where it no longer interferes or significantly attenuates signals being conveyed by the cable. Still others may reduce or control the magnitude of the suckout component.

20 Claims, 18 Drawing Sheets

(56) References Cited

OTHER PUBLICATIONS

De Araujo, D.N. et al.; "TwinAx Differential Cable Helical Shield Wrap Modeling,"; *IEEE*; 2007; pp. 299-302.

Josefsson, M. et al.; "Measuring and Modeling of Insertion Loss in Cables with Helical Screens,"; *International Wire & Cable Symposium, Proceedings of the 60th IWCS Conference*; 2011; pp. 139-145.

* cited by examiner

REDUCING SIGNAL LOSS IN CABLES

CROSS-REFERENCES TO RELATED APPLICATIONS

This application is a non-provisional of U.S. provisional patent application No. 61/723,312, filed Nov. 6, 2012, which is incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices. Since it is often desirable to transfer this data rapidly, the data rates of these transfers have substantially increased.

These data transfers may occur over various media. For example, the data transfers may be made wirelessly, over cables including wire conductors, over fiber optic cables, or they may be made in other ways.

Cables that include wire conductors may include a connector insert at each end. The connector inserts may be inserted into receptacles in the communicating electronic devices. Other cables may be tethered, that is, they may be connected directly to components internal to one of the communicating electronic devices.

Transferring data at these rates has proven to require new types of cable. Conventional cables are proving to have insufficient capabilities to handle signals at these higher data rates. New cables having improved capabilities are thus needed.

For example, conventional cables tend to have higher parasitic components, such as series resistance, than may be desirable. These parasitic components may degrade signal levels and, along with other factors (such as reflections and parasitic capacitances), lead to higher insertion losses. These higher insertion losses may lead to reduced signal amplitude and corrupted signal edges, making accurate data reception more difficult.

Thus, what is needed are circuits, methods, and apparatus that provide cables capable of high-speed data transmission and have a low insertion loss.

SUMMARY

Accordingly, embodiments of the present invention may provide cables capable of high-speed data transmission and having a low insertion loss. Specifically, embodiments of the present invention may provide cables having an eliminated, shifted, or reduced suckout component of insertion loss.

Various embodiments of the present invention may mitigate or reduce the effect of the suckout component of insertion loss. Embodiments of the present invention may accomplish this by eliminating, or at least partially eliminating, the suckout component by providing a continuous return path. Other embodiments may shift the frequency of the suckout component to a high frequency where it no longer interferes or significantly attenuates signals being conveyed by the cable. Still other embodiments of the present invention may reduce or control the magnitude of the suckout component.

Suckout may contribute to the insertion loss for cables. The result of suckout may be a band-stop filter characteristic in the transmission curve or a cable. This suckout may be partially due to losses in return paths of the cables. For example, a cable may include one or more conductors, such as a twisted pair. Forward current may (locally) flow in a first direction in the twisted pair. A return current may flow in a conductive tape layer, where the conductive tape layer is wrapped around the twisted pair. The return current may attempt to (locally) flow through the conductive tape layer in a second direction, which may be 180 degrees out of phase with the first direction. The return current path may cross one or more boundaries where the conductive tape overlaps itself. This boundary or overlap crossing may generate losses, which may cumulatively be referred to as suckout.

Accordingly, embodiments of the present invention may eliminate, or at least partially eliminate, this suckout component by providing a continuous return path, that is, a return path without boundary crossings. An illustrative embodiment of the present invention may provide a cable including a twisted pair and a conductive tape layer. The twisted pair may be twisted in a first direction such that it has a first pitch or lay length. The conductive tape layer may be wrapped around the twisted pair such that it overlaps itself to form boundaries or overlaps. The conductive tape layer may have a second pitch or lay length. The first lay length may match the second lay length. In this way, the local return current may flow in the conductive tape layer without, or with minimal, boundary or overlap crossings. These embodiments of the present invention may further include shields between the twisted pair and the tape layer, one or more drain lines twisted with the twisted pair, or they may include other structures.

Another illustrative embodiment of the present invention may provide a cable including a twisted pair and a shield layer. The shield layer may include a number of wires or conductors. The twisted pair may be twisted in a first direction such that it has a first lay length. The shield layer may be wrapped around the twisted pair in the first direction such that it has a second lay length. The first lay length may match the second lay length. Again, the local return current may flow in the shield layer without, or with minimal, crossings between shield wires or conductors. These embodiments of the present invention may further include tape layers around the twisted pair and the shield layer, one or more drain lines twisted with the twisted pair, or they may include other structures.

Another illustrative embodiment of the present invention may provide a cable including a twisted pair, a shield layer, and a conductive tape layer. The twisted pair may be twisted in a first direction such that it has a first lay length. The shield layer may include a number of conductors and may be wrapped around the twisted pair in the first direction such that it has a second lay length. The conductive tape layer may be wrapped around the twisted pair and shield layer such that it is in contact with the shield layer and such that it overlaps itself to form boundaries or overlaps. The conductive tape layer may have a third lay length. The second lay length and the third lay length may be mismatched such that they form a continuous return path for the length of the cable.

Various illustrative embodiments of the present invention may provide twisted pairs including one or more drain wires that are used in conjunction with a shield and a tape layer. In these embodiments of the present invention, lay lengths of the shield and tape layer may match each other, lay lengths of the twisted pair and drain wires may match, or all these lay lengths may match.

Other illustrative embodiments of the present invention may provide cables where the suckout component of the insertion loss is pushed out to high frequencies such that signals conveyed by the cable are not severely affected. In these embodiments, a lay length of either or both a twisted pair and tape layer are significantly reduced.

Other illustrative embodiments of the present invention may provide cables where the suckout component of the insertion loss is reduced in magnitude. One embodiment of the present invention may provide a cable where a lay length for a tape layer is greatly increased. This may reduce the number of boundary or overlap crossings, thus reducing the magnitude of the suckout.

Another illustrative embodiment of the present invention may provide a cable where a difference between a lay length of a twisted pair and a lay length of a tape layer is minimized. This minimization again may reduce the number of boundary or overlap crossings, thus reducing the magnitude of the suckout.

Another illustrative embodiment of the present invention may provide a cable where a lay length of a tape layer may vary over the length of a cable. Another illustrative embodiment of the present invention may provide a cable where a width of a tape layer, and therefore the overlap, may vary over the length of a cable. In still other embodiments, both the lay length and the width of the tape layer may vary over the length of a cable. These variations may effectively spread the suckout over a larger range of frequencies such that its effect is minimized or mitigated.

Embodiments of the present invention may be well-suited to improving the performance of twisted pairs, particularly twisted pairs conveying differential signals. Other embodiments of the present invention may be used to improve the performance of other types of conductors, such as coaxial cables, and other types of conductors.

Embodiments of the present invention may provide cables for various types of devices, such as portable computing devices, tablets, desktop computers, laptops, all-in-one computers, cell phones, smart phones, media phones, storage devices, portable media players, navigation systems, monitors, power supplies, adapters, and chargers, and other devices. These cables may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
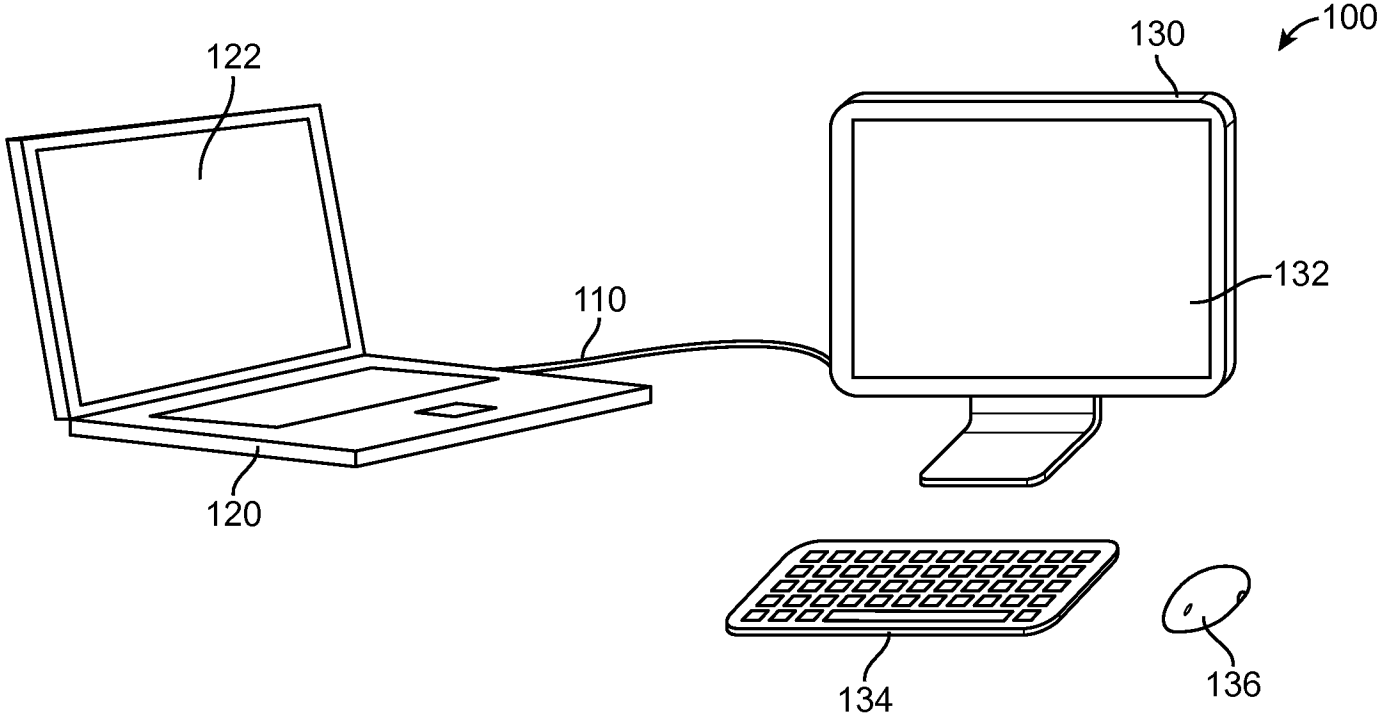
FIG. 1 illustrates an electronic system that may be improved by the incorporation of embodiments of the present invention.

FIG. 1 illustrates an electronic system that may be improved by the incorporation of embodiments of the present invention. This figure, as with the other included figures, is shown for illustrative purposes and does not limit either the possible embodiments of the present invention or the claims.

Electronic system 100 may include cable 110 joining electronic devices 120 and 130. Electronic device 120 may be a laptop or portable computer having screen 122. Electronic device 130 may be an all-in-one computer including screen 132, keyboard 134, and mouse 136. In other embodiments of the present invention, cable 110 may couple various types of devices, such as portable computing devices, tablets, desktop computers, cell phones, smart phones, media phones, storage devices, portable media players, navigation systems, monitors power supplies, adapters, and chargers, and other devices. These cables may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces.

Ideally, cable 110 would not attenuate or distort signals being transmitted between electronic device 120 and electronic device 130. But cable 110 may include various parasitics and non-ideal characteristics that may attenuate and distort these signals. These losses may be referred to as insertion losses. A simplified example is shown in the following figure.

Figure 2:
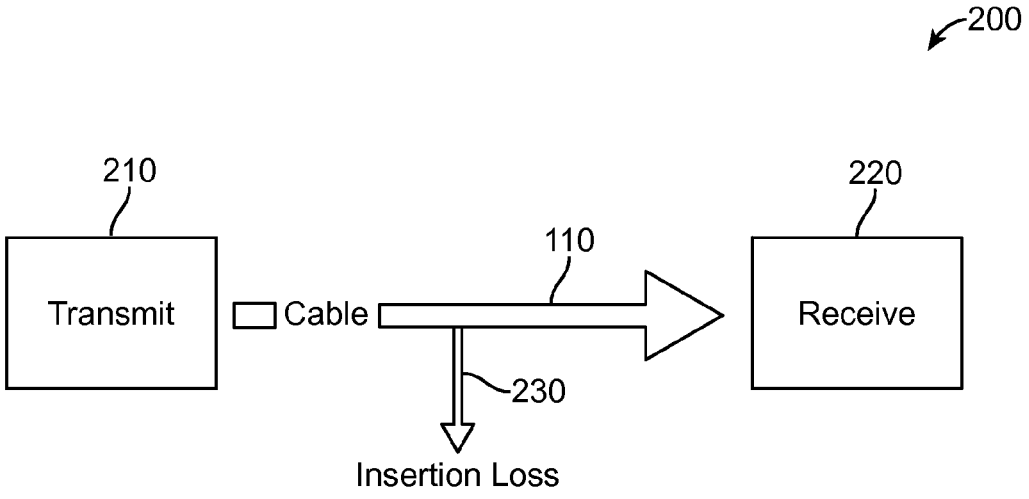
FIG. 2 illustrates a portion of electronic system that may be improved by the incorporation of embodiments of the present invention.

FIG. 2 illustrates a portion of electronic system that may be improved by the incorporation of embodiments of the present invention. Electronic system portion 200 may include a transmitter 210 and receiver 220. Transmitter 210 may provide signals to receiver 220 over cable 110. Some of the signal amplitude and phase information provided by transmitter 210 to cable 110 may be lost en route to receiver 220. These losses may be referred to as insertion loss 230.

One component of this insertion loss may be referred to as suckout. One source of this suckout may be caused by aspects of the construction of a ground or return path in cable 110.

This is shown further below. A graph showing the suckout frequency characteristics of a cable are shown in the following figure.

Figure 3:
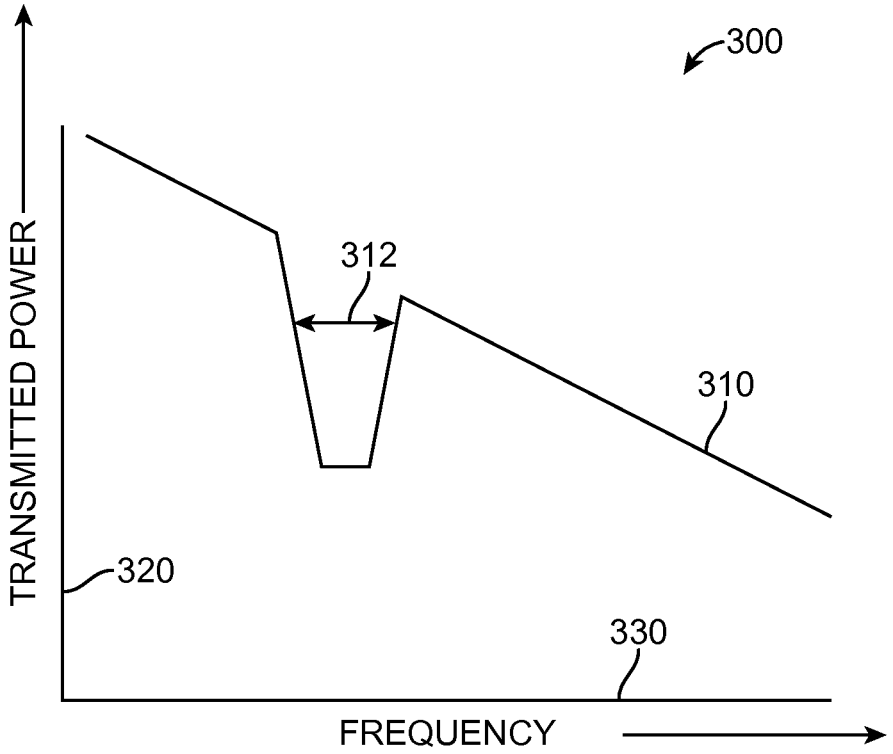
FIG. 3 is a graph illustrating the effect of suckout on a transmitted power curve as a function of frequency for a cable that may be improved by the incorporation of an embodiment of the present invention.

FIG. 3 is a graph illustrating the effect of suckout on a transmitted power curve as a function of frequency for a cable that may be improved by the incorporation of an embodiment of the present invention. In graph 300, transmitted power 310 is shown along axis 320 as a function of frequency 330. Transmit power may be the power that is actually received at receiver 220 when a transmitter 210 is an ideal source. A notch or band-stop characteristic 312 may be the result of suckout in cable 110.

Figure 9:
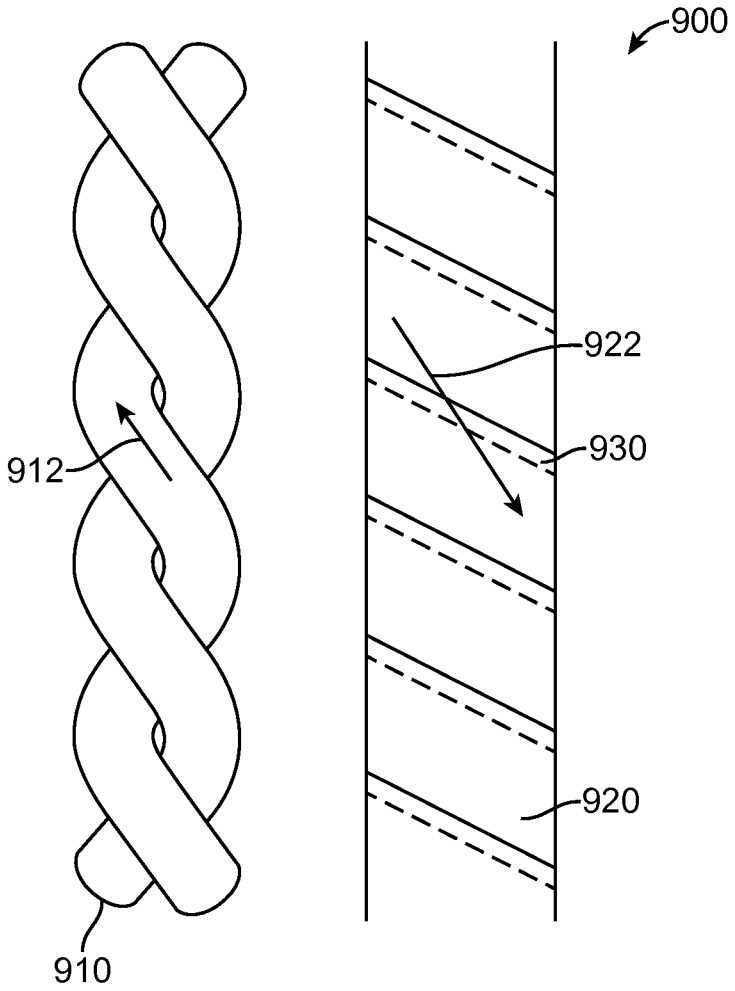
FIG. 9 illustrates forward and return currents in a portion of a cable that may be improved by the incorporation of an embodiment of the present invention.
Figure 10:
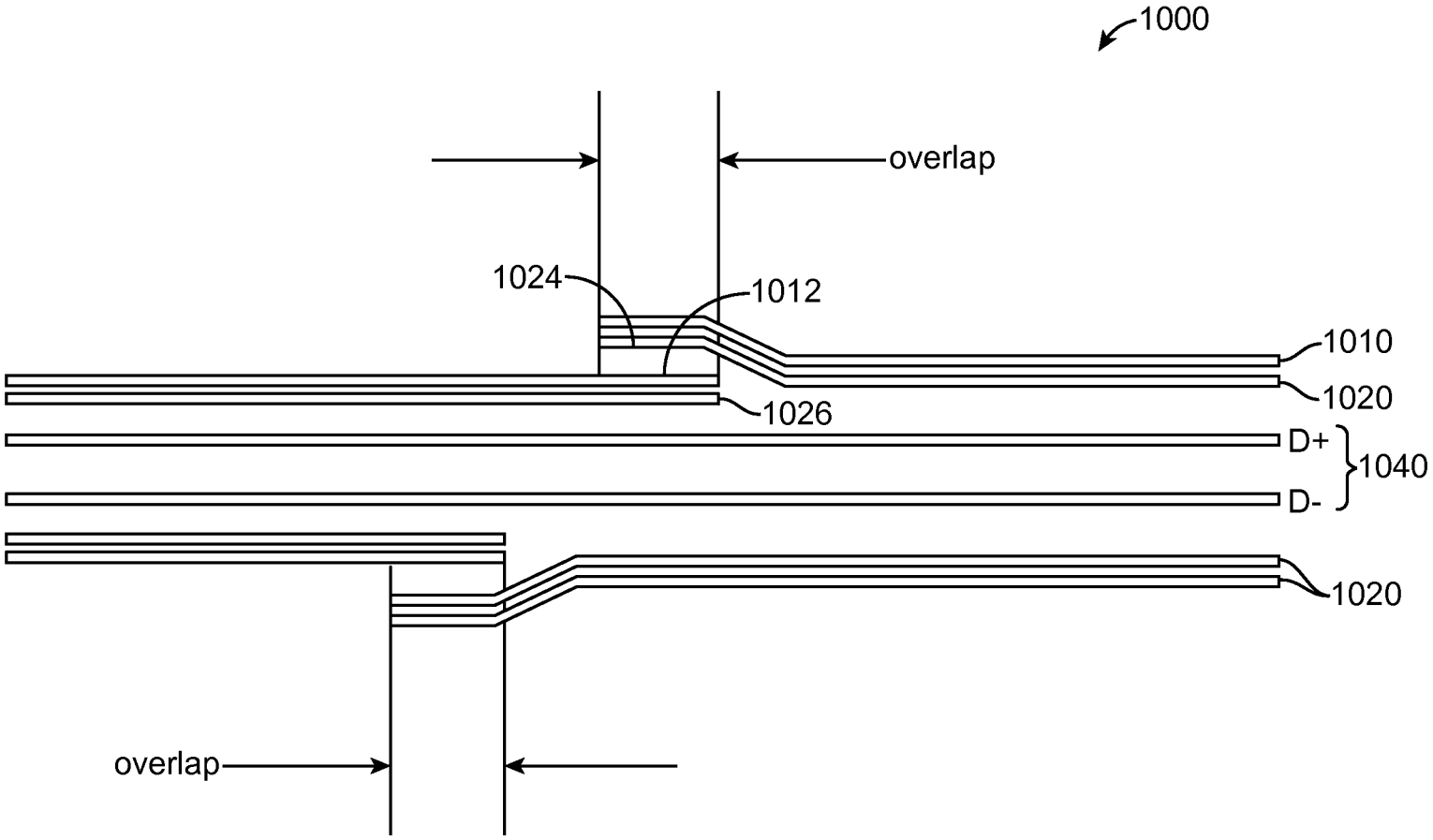
FIG. 10 illustrates a simplified side view of a cable portion that may be improved by the incorporation of an embodiment the present invention.

Suckout 312 may be the result of physical characteristics of the components in cable 110. FIG. 4 through FIG. 8 below illustrate some of these characteristics, while FIG. 9 and FIG. 10 illustrate the causes of suckout. FIG. 11 through FIG. 18 illustrate cables and methods for mitigating suckout according to embodiments of the present invention.

Figure 4:
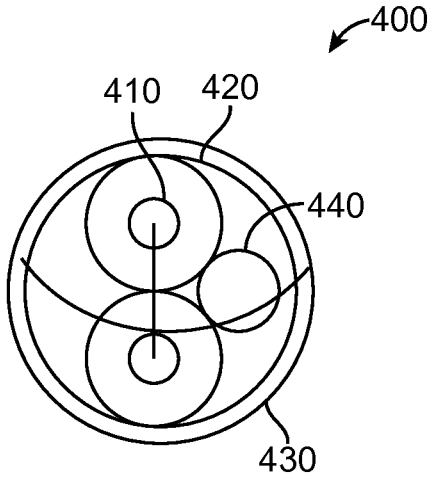
FIG. 4 illustrates a portion of a cable according to an embodiment of the present invention.

FIG. 4 illustrates a portion of a cable according to an embodiment of the present invention. Cable portion 400 may be included in cable 110 and other such cables. Cable portion 400 may include a twisted pair formed by conductors 410, which may be insulated by layers 420. This twisted-pair may be surrounded by tape layer 430. A drain wire 440 may be optionally included, though it may be omitted. Drain wire 440 may be twisted with the twisted-pair and wrapped by tape layer 430.

Tape layer 430 may be formed of polyester or other type of film, which may be metallized on one side. The polyester film may be Mylar™ or other such film. One side of tape layer 430 may be metallized with copper, aluminum, or other conductive material. Tape layer 430 may be oriented such that the copper metallization may be in contact with drain wire 440.

Figure 5:
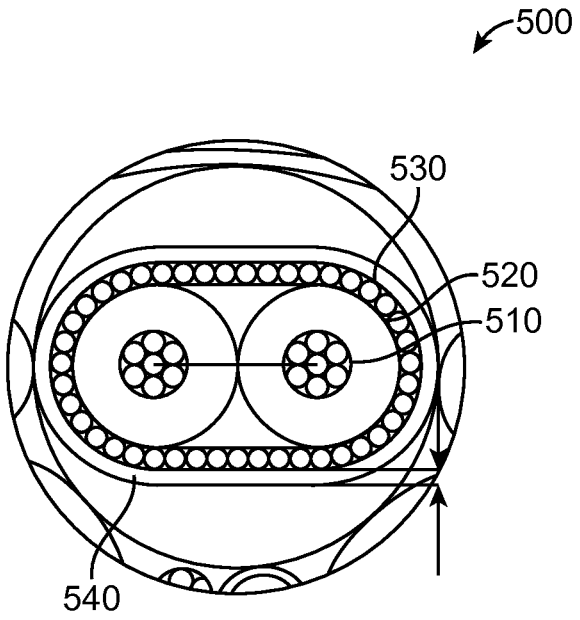
FIG. 5 illustrates a portion of a cable according to an embodiment of the present invention.

FIG. 5 illustrates a portion of a cable according to an embodiment of the present invention. Cable 500 may be included in cable 110 and other such cables. Cable portion 500 may include a twisted pair formed by conductors 510, which may be insulated by insulating layer 520. Spiral shield 530 may surround the twisted-pair. Tape layer 540 may wrap around spiral shield 530.

Cables 110 may include various conductors such as twisted pairs formed by conductors 410 and 510. Cable 110 may also include other component such as drain wires, shielding, jacket pairs, single conductors, fibers, such as cotton or aramid fibers, and other components. Also, while embodiments of the present invention may be well-suited to improving the performance of twisted pairs, particularly twisted pairs conveying differential signals, other embodiments of the present invention may be used to improve the performance of other types of conductors, such as coaxial cables, and other types of conductors.

Tape layers 430 and 540 may wrap around their twisted pairs in a helical fashion. A length of a single twist or 360-degree rotation of this helix may be referred to as a pitch or lay length. An example is shown in the following figure.

Figure 6:
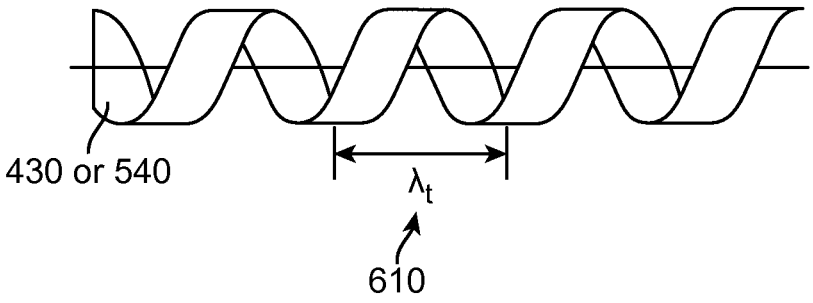
FIG. 6 illustrates a pitch or lay length of a tape layer according to an embodiment of the present invention.

FIG. 6 illustrates a pitch or lay length of a tape layer according to an embodiment of the present invention. Tape layer 430 or 540 may be wrapped in the helical fashion around one or more twisted pairs, drain wires, or other conductors. The length of single twist or 360 degree rotation of the tape layer may be referred to as a pitch or lay length 610.

In this example, twists in tape layers 430 and 540 are shown as having a gap between them. In other embodiments of the present invention, tape layer 430 or 540 may overlap itself by a certain amount. This overlap may be anywhere from zero or a few percent of the width of the tape, to 10 to 20 percent, and up to 50 percent or more of the width of the tape.

Tape layer 430 or 540 may be twisted in one of two directions. That is, it may be twisted in a first or second direction. Directions may be thought of as clockwise or counterclockwise rotation directions. Whether a rotation appears to be clockwise or counterclockwise may depend on ones frame of reference.

Just as the tape layer may have a pitch or lay length associated with it, so do the twisted-pairs formed by conductors 410 or 510. An example is shown in the following figure.

Figure 7:
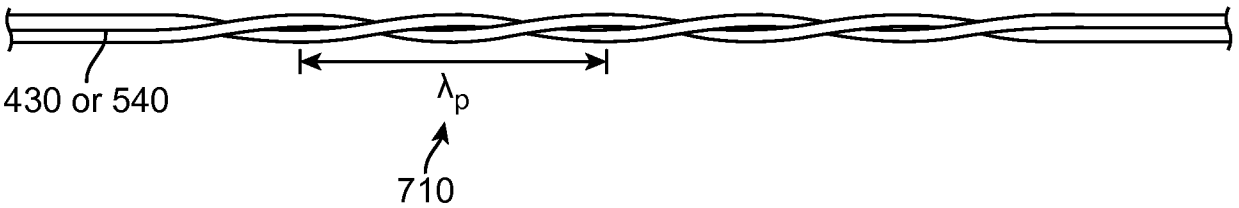
FIG. 7 illustrates a pitch or lay length of a twisted-pair according to an embodiment of the present invention.

FIG. 7 illustrates a pitch or lay length of a twisted-pair according to an embodiment of the present invention. Twisted pairs formed by conductors 410 or 510 may be twisted such that they have a lay length 710 as shown. Again, these twisted pairs may be twisted in a first direction or a second direction, or in either a clockwise or counterclockwise manner.

Just as the twisted-pair and tape layers may have a lay length, so may shield 530. An example is shown in the following figure.

Figure 8:
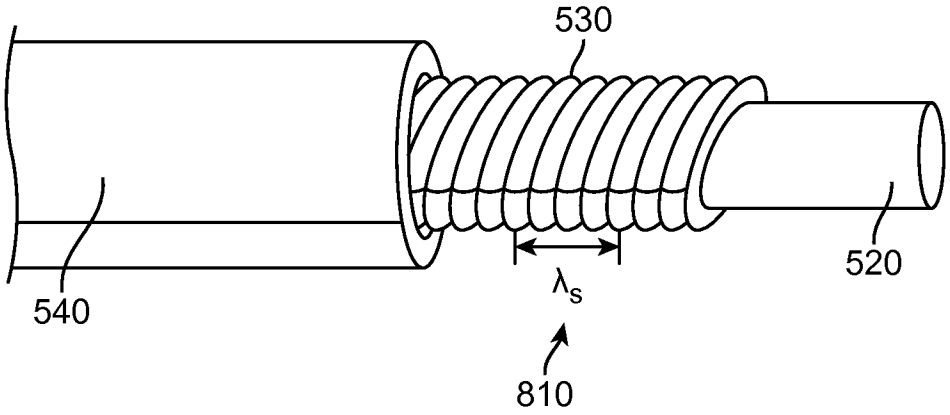
FIG. 8 illustrates a pitch or lay length of a shield layer according to embodiment of the present invention.

FIG. 8 illustrates a pitch or lay length of a shield layer according to embodiment of the present invention. Shield 530 may be formed of a number of wires or conductors. These wires are conductors may be twisted such that they have a lay length 810 as shown. Again, these shield conductors may be twisted in a first direction or a second direction, or in either a clockwise or counterclockwise manner.

In cable portion 400 as shown in FIG. 4, signals, such as differential pair signals may be provided over twisted pair conductors 410. This may generate forward currents in twisted pair conductors 410. Return current may be generated and it may return through tape layer 430 (ignoring drain wire 440, if present.) The return current may flow in a path that may be aligned with the forward current in the twisted-pair. Because of this, the return current may need to flow across portions of the tape that overlap each other. Current flow through these discontinuities may result in losses. The result of the losses may be the suckout notch 312 in transmitted power 300 as shown in FIG. 3. The origins of these losses are shown further in the following figures.

FIG. 9 illustrates forward and return currents in a portion of a cable that may be improved by the incorporation of an embodiment of the present invention. This figure may include a twisted pair 910 formed by two conductors and a tape layer 920. Tape layer 920 is shown separately from twisted pair 910 for clarity. In actual embodiments, tape layer 920 wraps around twisted pair 910. This same arrangement is used in several of the following figures. Tape layer 920 may be wrapped around conductors of twisted pair 910 such that tape layer 920 includes overlap portion 930.

Forward current 912 may flow in twisted-pair 910. A return current 922 in shield 920 may thus be generated in the opposite direction. As can be seen, this direction takes current 922 across overlap or boundary areas 930. Again, this overlap or boundary crossing may cause losses, which may result in suckout. Further details are shown in the following figure.

FIG. 10 illustrates a simplified side view of a cable portion that may be improved by the incorporation of an embodiment the present invention. Again, tape layers may be formed of a polyester film 1010 is metallized by copper layer 1020. The resulting tape layer may be wrapped around twisted-pair conductors 1040 such that an overlap portion 1030 is formed. A forward current 1042 may be developed in a conductor in twisted-pair 1040. A return current 1022 may be developed in copper metallization layer 1020.

Unfortunately the path formed by the copper metallization layer 1020 has a gap across overlap portion 1030. This may mean that current 1022 flows through a capacitor or gap formed at overlap 1030. Specifically, current 1022 may flow through a capacitor formed by copper layer portions 1024 and 1026, which are insulated by a dielectric formed by polyester layer portion 1012.

While the above examples illustrate overlap portions in tape layers, similar effects can be seen in a shield layer, when a shield layer is present. Again, a shield layer may be formed by one or more conductors wrapped around a twisted pair. Return current may flow in a direction that cuts across several conductors. In this situation, gaps or boundaries between the conductors may cause losses similar to those generated by overlap portions 930.

In order to avoid current flow through the overlap and boundary portions in shield and tape layers, embodiments of the present invention may provide cable portions have a continuous return path. In a particular embodiment of the present invention, this may be achieved by matching a lay length of a twisted-pair to a lay length of a tape layer. An example is shown in the following figure.

Figure 11:
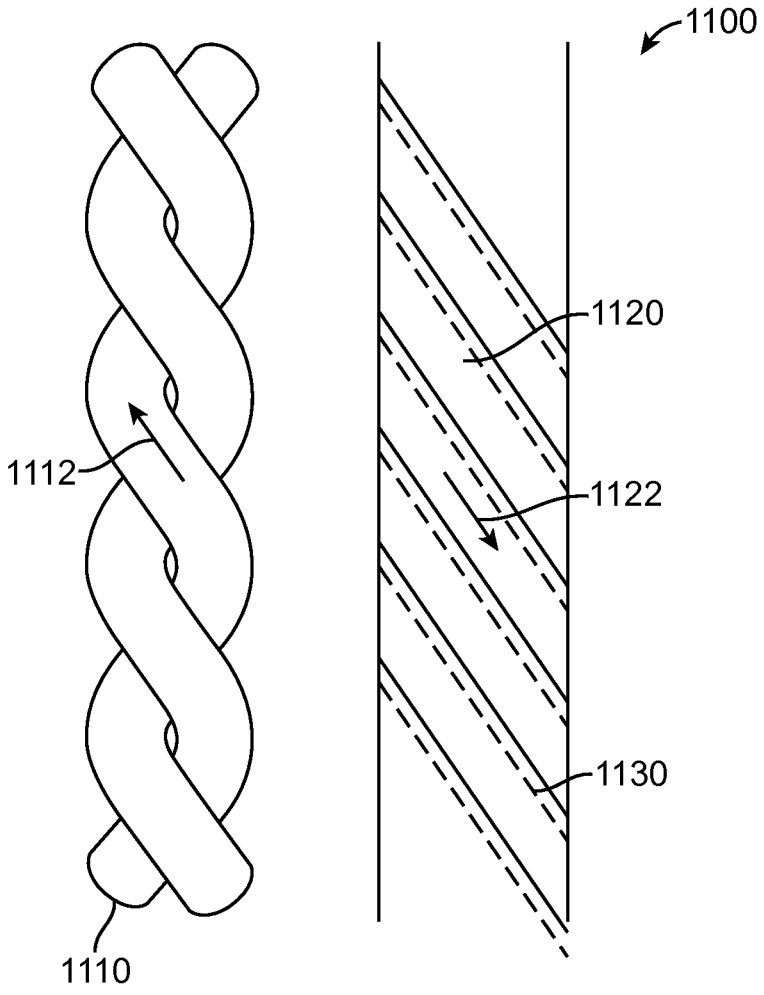
FIG. 11 illustrates a portion of a cable according to an embodiment of the present invention.

FIG. 11 illustrates a portion of a cable according to an embodiment of the present invention. This figure illustrates a differential pair 1110 and tape layer 1120. Forward current 1112 may flow in a conductor in twisted-pair 1110. Return current 1122 may thus be generated in tape layer 1120. Since a lay length of tape layer 1120 matches a lay length of twisted-pair 1110, current flow 1122 may be in a direction along the length of tape layer 1120, and either does not cross boundaries 1130, or crosses a minimized number of boundaries 1130.

Mathematically, this may be explained as follows.

The frequency of the suckout stop band may be found by Equation 1:

$$f = \frac{v}{\lambda}$$

where f is frequency of the suckout, λ is pitch or lay length, and v is phase speed or phase velocity.

The combined speed of propagation, or phase speed, for the twisted pair and tape layer can be found by $$v_c = \frac{v_p \cdot v_t \cos\alpha \cdot c_0}{v_p + v_t \cos\alpha}$$

where c is the speed of light, p is the twisted pair, t is the tape layer, and α is the pitch angle of the tape layer.

The combined lay length of the twisted pair and tape layer can be found by Equation 2:

$$\lambda_c = \left|\frac{\lambda_p \cdot \lambda_t}{\lambda_p - \lambda_t}\right|$$

again, where p is the twisted pair and t is the tape layer. From Equation 2, we can see if we make the two lay lengths equal, the denominator goes to zero, and the combined lay length goes to infinity. Substituting this result into Equation 1, we may see that $$\lambda_c = \left|\frac{\lambda_p \cdot \lambda_z}{\lambda_p - \lambda_z}\right| = \left|\frac{\lambda_p \cdot \lambda_p}{\lambda_p - \lambda_p}\right| = \infty,$$

-continued $$f_{suckout} = \frac{V_c}{\infty} = 0$$

Accordingly, if we make the two lay lengths equal, we can remove the suckout for the cable.

In this and other embodiments of the present invention, a shield may be included. In these embodiments of the present invention, a shield layer may have a lay length that is different than the lay length of the twisted pair (and hence the tape layer), or it may have a lay length that matches the lay length of the twisted-pair. In this way, return currents generated in a shield layer may flow without crossing from one conductive strand to another. In still other embodiments the present invention, the twisted-pair, shield, and tape layers may all have a similar or the same lay length.

In this and other embodiments of the present invention, the shield layer and tape layers maybe electrically connected along the length of the cable. In this case, overlap and boundaries in the tape in shield layers may be offset such that they don't line up. This may provide a current path through the tape layer at shield boundaries, and through the shield layer at tape layer overlap portions. This may therefore provide a continuous return path. An example is shown in the following figure.

Figure 12:
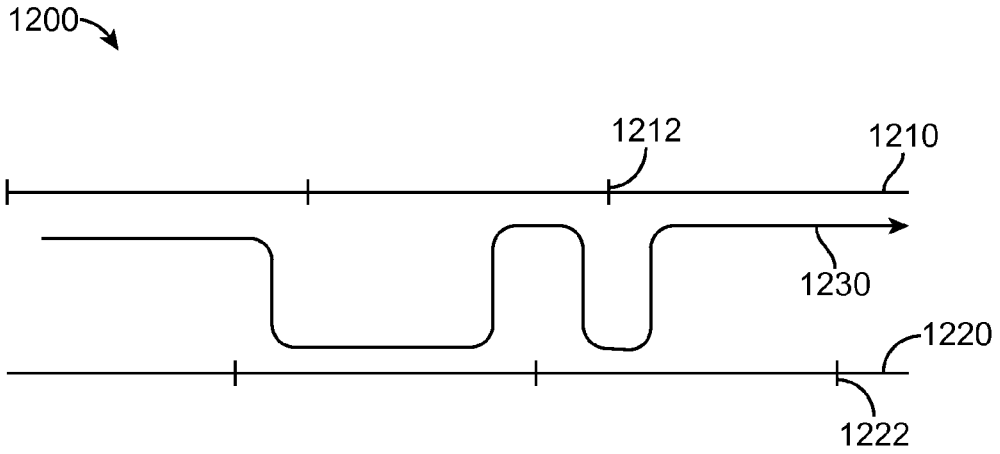
FIG. 12 illustrates portions of a shield layer and tape layer according to an embodiment of the present invention.

FIG. 12 illustrates portions of a shield layer and tape layer according to an embodiment of the present invention. Shield layer 1210 may have boundary portions located at points 1212. Tape layer 1220 may have overlap portions located at points 1222. In this example, the locations of boundary portions 1212 and overlap portions 1222 are offset, such that current 1230 may always have a path where it can avoid boundary portions 1212 and overlap portions 1222.

Mathematically, this may be seen as placing boundary portions 1212 and overlap portions 1222 at locations such that a length of the cable is shorter than the least common multiple of the lay lengths of the lay length of the tape layer and the shield layer, or $$\mathrm{LCM}(\lambda_t, \lambda_s) > L_{cable}$$

In other embodiments of the present invention, a shield and one, two, or more drain wires may be included as a return path, or as part of a return path, that may further include a tape layer. An example is shown in the following figure.

Figure 13:
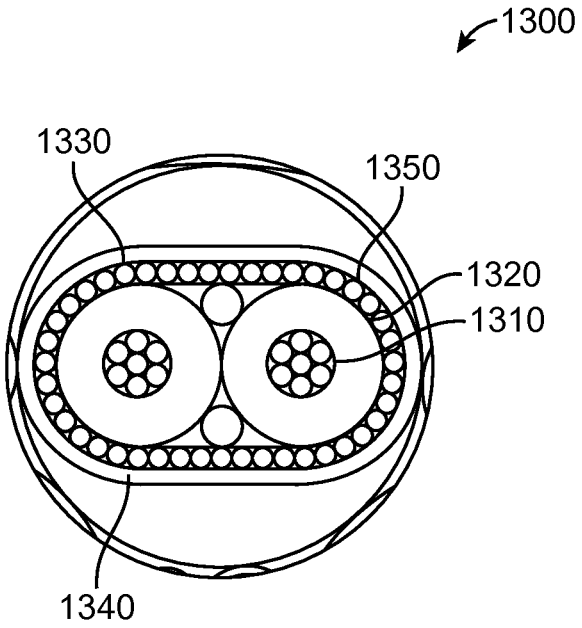
FIG. 13 illustrates a portion of a cable according to an embodiment of the present invention.

FIG. 13 illustrates a portion of a cable according to an embodiment of the present invention. Cable portion 1300 may include conductors 1310 surrounded by insulation layer 1320. Shield layer 1330 may surround the twisted-pair and be wrapped by tape layer 1340. Drain wires 1350 may be included inside shield layer 1350. In this example, a lay length of drain wire 1350 may match the lay length of twisted-pair formed by conductors 1310. Similarly, a pitch or lay length of the shield layer 1330 may match the pitch or lay length of tape layer 1340. That is, $$\lambda_t = \lambda_s \text{ and } \lambda_d = \lambda_p$$

In other embodiments of the present invention, each of these pitches or lay lengths may match each other. That is, $$\lambda_t = \lambda_s = \lambda_d = \lambda_p$$

In other embodiments of the present invention, instead of providing a continuous return path, the frequency of the suckout can be pushed out to higher frequencies. An example is shown in the following figure.

As can be seen in Equation 2, the numerator, and therefore the combined lay length, may be driven to zero if the lay length of either of the tape layer or twisted pair is driven near zero. This in turn, combined with Equation 1, shows that the suckout frequency may be pushed out in frequency. This may be shown specifically in Equations 3 (for combined lay length) and 4 (for suckout frequency), $$\lim_{\lambda_g \to 0} \lambda_c = \left| \frac{\lambda_p \cdot 0}{\lambda_p - 0} \right| = 0,$$

$$f_{suckout} = \frac{V_c}{0} = \infty$$

An example of such a configuration is shown following figure.

Figure 14:
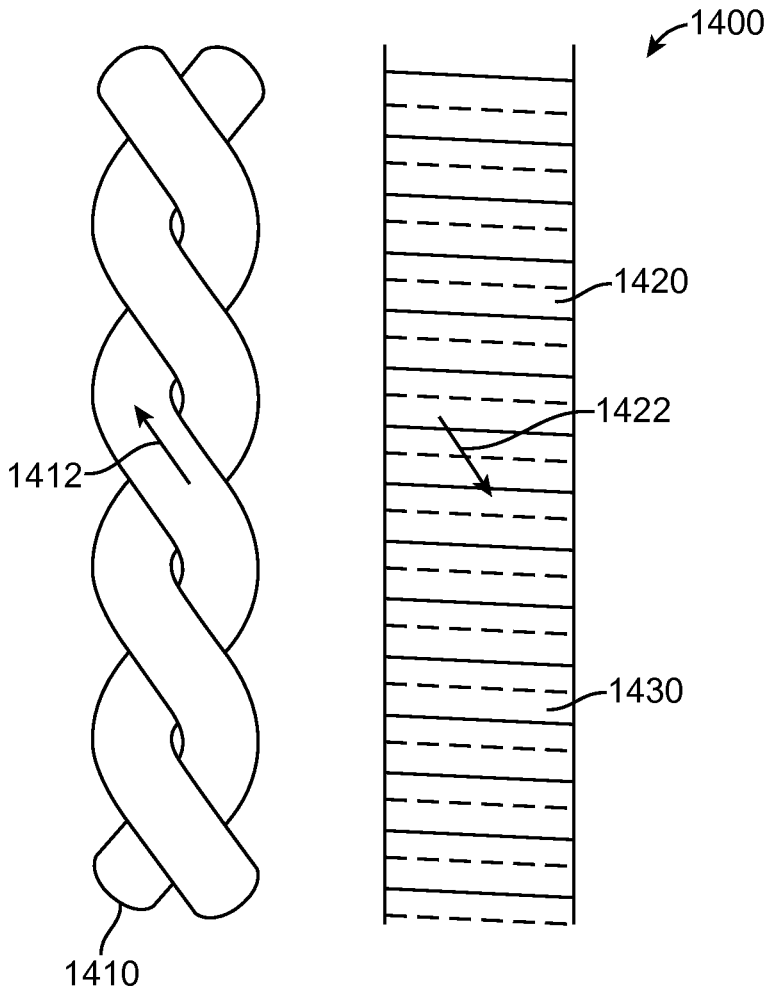
FIG. 14 illustrates a portion of a cable according to an embodiment of the present invention.

FIG. 14 illustrates a portion of a cable according to an embodiment of the present invention. Cable portion 1400 may include differential pair 1410 and tape layer 1420. In this example, tape layer 1420 has a very short lay length. In other embodiments of the present invention, tape layer 1420 may include or be replaced with a shield layer. A forward current 1412 may be generated in twisted pair 1410. Return current 1422 may be generated in tape layer 1420. Return current 1422 may cross several boundaries 1430. This reduced lay length may make the denominator in Equation 4 zero, which may push the frequency of the stop band created by suckout far enough out of frequency range to not attenuate or distort signals conveyed on cable portion 1400.

Again, twisted pair 1410 may be twisted such that has a very short lay length. However, this may not be as practical to manufacture as a short lay length for tape layer 1420.

In other embodiments of the present invention, the magnitude of the suckout can be reduced. For example, in other embodiments of the present invention, a lay length of a tape or shield layer may be very long. This long length may reduce a number of boundaries crossed by a return current. An example is shown in the following figure.

Figure 15:
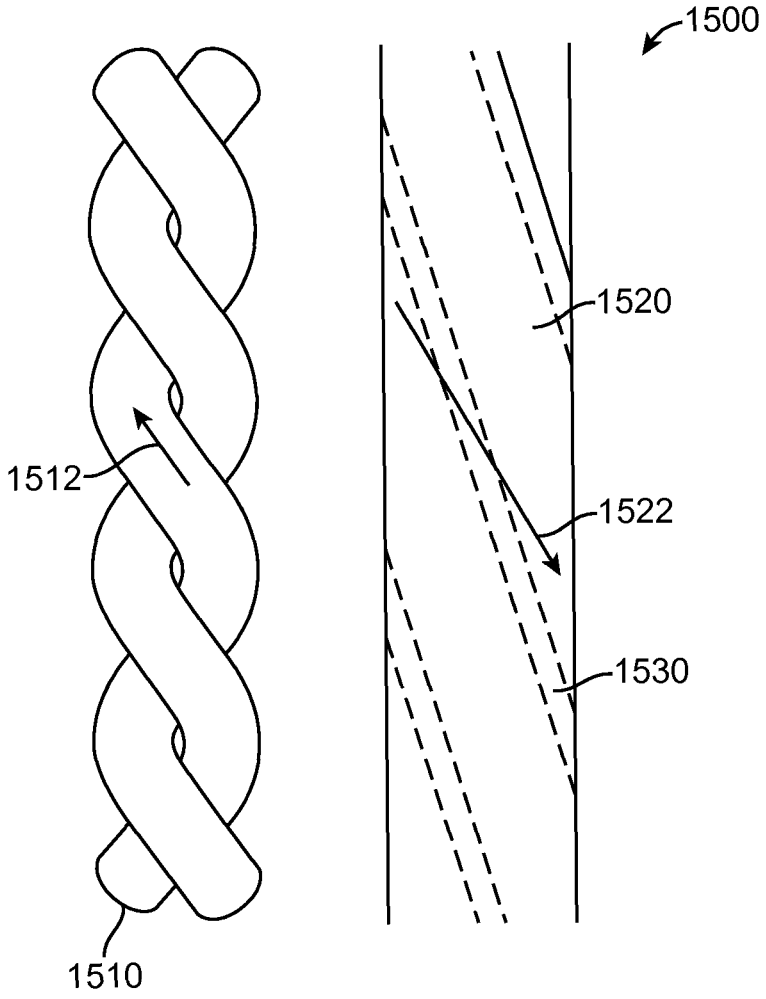
FIG. 15 illustrates a portion of a cable according to an embodiment of the present invention.

FIG. 15 illustrates a portion of a cable according to an embodiment of the present invention. Cable portion 1500 may include twisted pair 1510 and tape layer 1520. In other embodiments of the present invention, tape layer 1520 may include or be replaced with a shield layer. In this example, a forward current 1512 may be generated in twisted-pair 1510. Return current 1522 may be generated in tape layer 1520. Since tape layer 1520 has a very long lay length, current 1522 may cross a reduced number of overlap or boundary portions 1530. This in turn may reduce the magnitude of suckout in cable portion 1500. Mathematically, $$N = \frac{L_{cable}}{\lambda_t},$$

As $\lambda_t$ increases, N decreases.

In other embodiments of the present invention, instead of providing a continuous return path by matching lay lengths, differences between lay lengths of twisted pairs and tape (or shield) may be minimized. This may again help to reduce the magnitude of the suckout, even if it is not eliminated or nearly eliminated.

In other embodiments of the present invention, the lay length of a shield layer or a tape layer may be varied over length of a cable. This variation may effectively spread the frequencies of the suckout, thereby reducing its magnitude. Examples are shown in the following figures.

Figure 16:
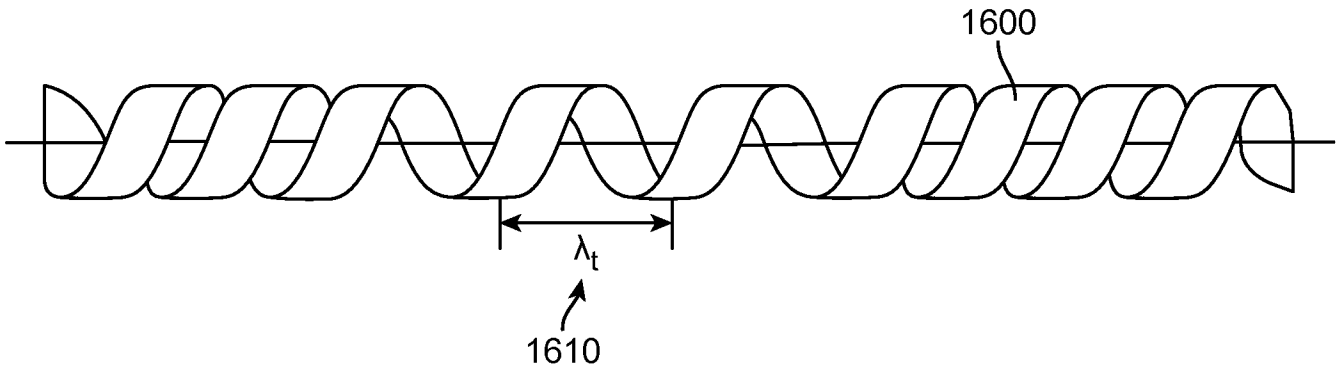
FIG. 16 illustrates tape layer having a lay length that varies over or a length of a cable.
Figure 17:
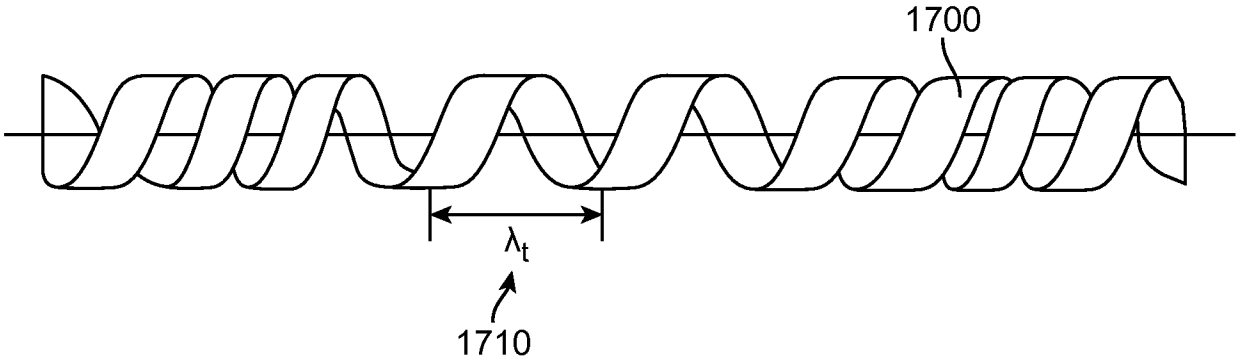
FIG. 17 illustrates tape layer having a lay length and a width that vary over or a length of a cable.

FIG. 16 illustrates tape layer 1600 having a lay length 1610 that varies over or a length of a cable. In other embodiments of the present invention, a width of tape layer 1600 may vary over length of the cable. In still other embodiments of the present invention, both the width and lay length of a tape layer may be varied. An example is shown in FIG. 17.

As was shown in FIG. 10, a cause of suckout may be that current flows through a capacitor formed by the copper and polyester layers in the tape layer. Accordingly, embodiments of the present invention may remove the polyester layer and replace the tape layer with the copper layer. An example is shown in the following figure.

Figure 18:
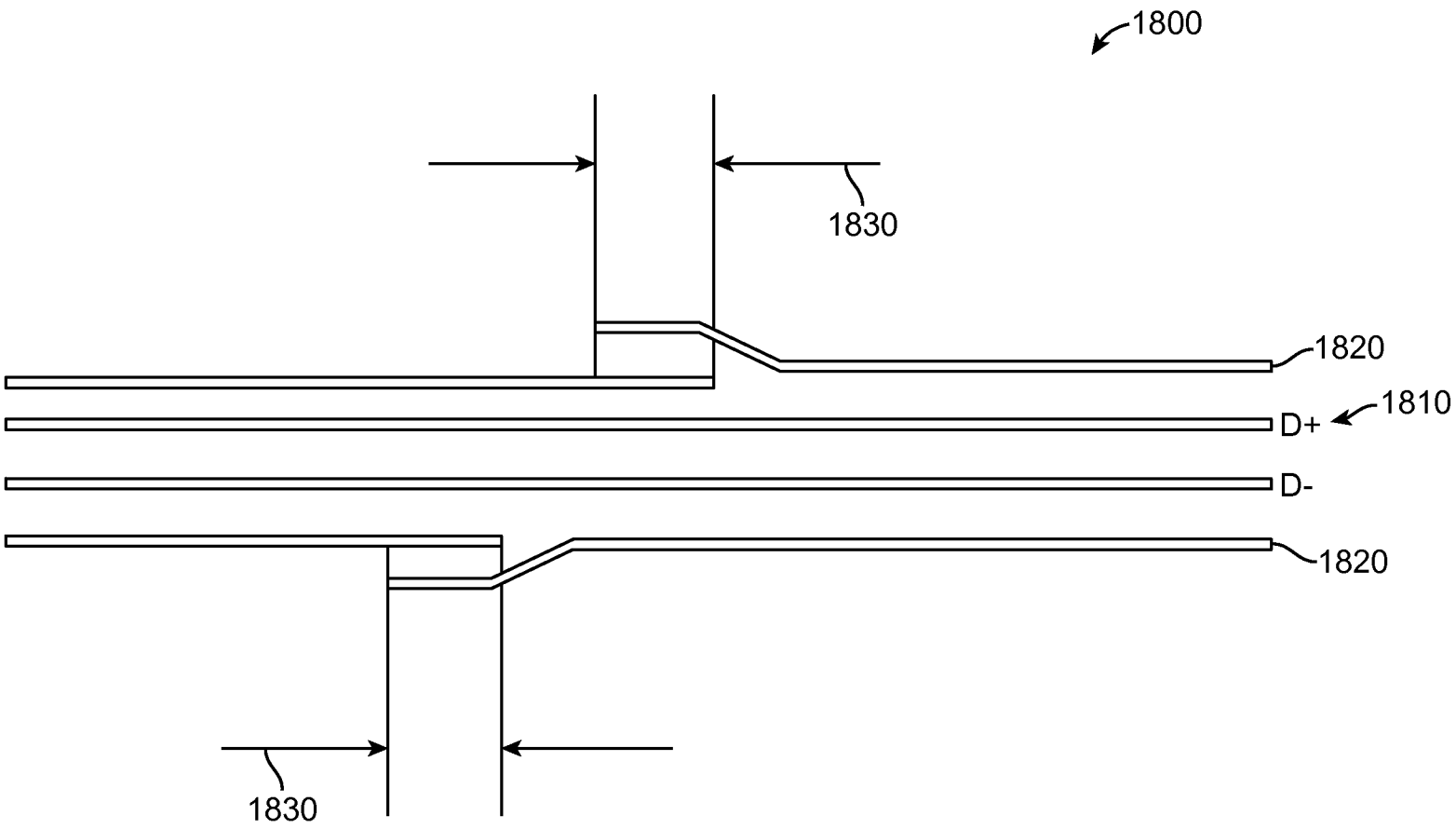
FIG. 18 illustrates a simplified side view of a portion of the cable according to an embodiment of the present invention.

FIG. 18 illustrates a simplified side view of a portion of the cable according to an embodiment of the present invention. Cable portion 1800 may include differential pairs 1810 surrounded by copper layer 1820. As copper layer 1820 overlaps with itself at portions 1830, copper is in contact with copper and no capacitors in the overlap areas formed. Again, this may provide a continuous return path for cable portion 1800.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A cable comprising:

a first twisted pair twisted in a first direction to have a first lay length, the twisted pair including a first conductor and a second conductor; and a tape layer wrapped around the first twisted pair in the first direction and having a second lay length, wherein the first lay length and the second lay length are at least approximately equal.

2. The cable of claim 1 wherein the first lay length and the second lay length are equal.

3. The cable of claim 1 further comprising a drain wire inside the tape layer.

4. The cable of claim 3 further comprising a shield layer inside the tape layer.

5. The cable of claim 4 wherein the shield layer comprises a plurality of conductors twisted around the first twisted pair to have a third lay length, the third lay length at least approximately equal to the first lay length.

6. The cable of claim 5 wherein the plurality of conductors are twisted around the first twisted pair in the first direction.

7. A cable comprising:

a first twisted pair twisted in a first direction to have a first lay length, the twisted pair including a first conductor and a second conductor;

a shield layer comprising a plurality of conductors twisted around the first twisted pair in the first direction to have a second lay length, the second lay length at least approximately equal to the first lay length; and a tape layer wrapped around the shield layer.

8. The cable of claim 7 wherein the tape layer has a third lay length and the first lay length and the third lay length are at least approximately equal.

9. The cable of claim 8 wherein the tape layer is wrapped around the first twisted pair in the first direction.

10. The cable of claim 8 further comprising a drain wire inside the tape layer.

11. A cable comprising:

a first twisted pair twisted to have a first lay length, the twisted pair including a first conductor and a second conductor;

a shield layer comprising a plurality of conductors twisted around the first twisted pair to have a second lay length; and a tape layer wrapped around the shield layer, the tape layer having a third lay length, wherein the second lay length and the third lay length are mismatched such that they form a continuous return path for the length of the cable.

12. The cable of claim 11 wherein the shield layer is twisted around the first twisted pair in a first direction and the tape layer is wrapped around the first twisted pair in the first direction.

13. The cable of claim 11 wherein the first twisted pair is twisted in the first direction.

14. A cable comprising:

a first twisted pair twisted to have a first lay length, the twisted pair including a first conductor and a second conductor;

a drain wire twisted with the first twisted pair to have the first lay length;

a shield layer comprising a plurality of conductors twisted around the first twisted pair to have a second lay length; and a tape layer wrapped around the shield layer, the tape layer having a third lay length.

15. The cable of claim 14 further comprising a second drain wire twisted with the first twisted pair to have the first lay length.

16. The cable of claim 14 wherein the second lay length is at least approximately equal to the third lay length.

17. The cable of claim 16 wherein the first lay length is at least approximately equal to the second lay length and the third lay length.

18. A cable comprising:

a first twisted pair twisted in a first direction to have a first lay length, the twisted pair including a first conductor and a second conductor; and a tape layer wrapped around the first twisted pair in the first direction and having a second lay length, wherein the first lay length is greater than the second lay length by at least a factor of two.

19. The cable of claim 18 wherein the first lay length is greater than the second lay length by at least a factor of five.

20. A cable comprising:

a first twisted pair twisted in a first direction to have a first lay length, the twisted pair including a first conductor and a second conductor; and a tape layer having a first width and wrapped around the first twisted pair in the first direction, the tape layer having a second lay length, wherein the first width is constant and the second lay length is variable.

* * * * *